United States Patent [19]

Thomas, Jr.

[11] 4,174,668

[45] Nov. 20, 1979

[54] GRATING OPENING IN A WORKING TABLE FOR VERTICAL STORAGE

[76] Inventor: Donald K. Thomas, Jr., 1710 Laurel St., South Pasadena, Calif. 91030

[21] Appl. No.: 931,761

[22] Filed: Aug. 7, 1978

[51] Int. Cl.[2] ..... A47B 3/06

[52] U.S. Cl. ..... 108/25; 52/585; 52/664; 108/11; 108/90

[58] Field of Search ..... 108/25, 11, 13, 14, 108/29, 59, 90, 24; 211/153; 52/585, 664, 36, 507

[56] References Cited

U.S. PATENT DOCUMENTS

| | | | |
|---|---|---|---|
| 1,853,808 | 4/1932 | Greenwood | 108/24 |
| 2,646,575 | 7/1953 | Galley | 108/25 UX |
| 2,897,973 | 8/1959 | Sizemore | 108/24 |
| 3,362,767 | 1/1968 | Chancellor, Jr. | 108/13 X |
| 3,688,707 | 9/1972 | White | 108/25 X |
| 3,745,303 | 7/1973 | Epperson et al. | 108/25 X |

FOREIGN PATENT DOCUMENTS

| | | | |
|---|---|---|---|
| 2300520 | 2/1975 | France | 108/25 |

*Primary Examiner*—Ramon S. Britts
*Assistant Examiner*—Peter A. Aschenbrenner
*Attorney, Agent, or Firm*—Huebner & Worrel

[57] ABSTRACT

A working table or desk having a grating for vertical storage of material in elongated form, such as rolled blueprints. The table has a vertically directed opening with grating forming rods extending thereacross to form spaces for inserting rolled documents for storage. A container is positioned below the opening on the floor to receive the lower ends of the material. The opening has vertical surfaces having spaced horizontally directed holes therein. Each hole on each surface is in alignment with an opposite hole in an opposite surface to receive the rods forming the grating. One of each pair of oppositely aligned holes is deeper than the other to receive a coil spring. Each rod is inserted into a deeper hole to be in abutment with the spring, the spring being compressed to permit the entry of the rod across the opening and when so compressed the other end of the rod is within the opening and in position to be forced into the opposite hole by the bias of the spring. The spring thus holds each rod in place. In order to provide an arrangement of crossing rods to form the grating, holes in faces adjacent to faces having a first group of holes are bored at a higher level so that the rods may fit above the first rods and cross the latter.

A cover to rest on the upper rods is provided to close the opening when it is not being used for storage. The cover matches the top of the working table.

7 Claims, 5 Drawing Figures

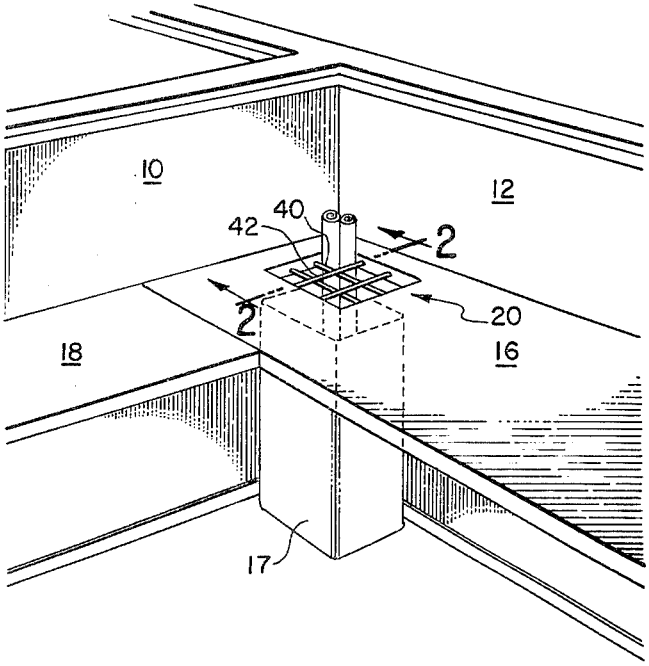
FIG. 1.
FIG. 2.
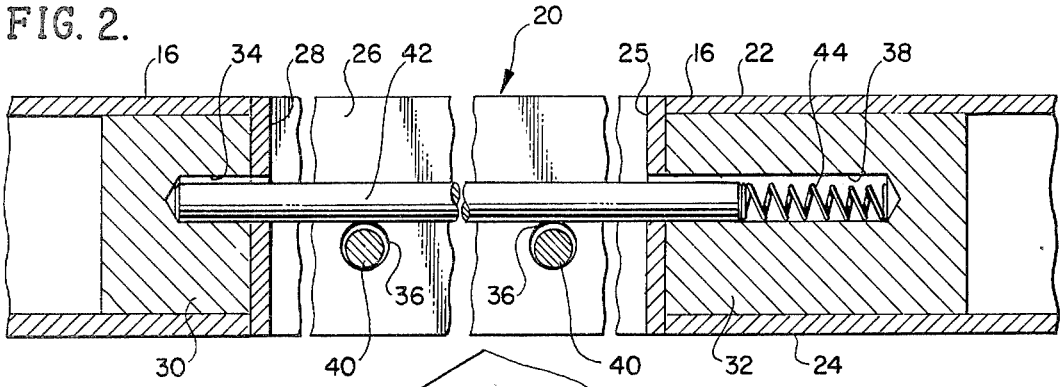
FIG. 3.
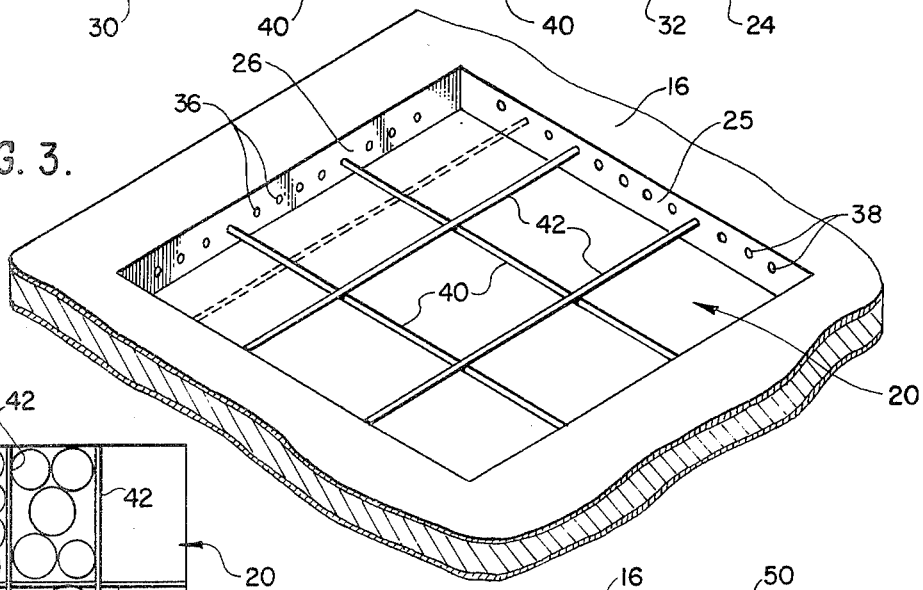
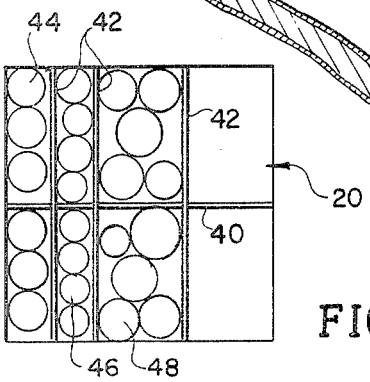
FIG. 4.
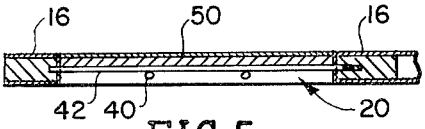
FIG. 5.

GRATING OPENING IN A WORKING TABLE FOR VERTICAL STORAGE

BACKGROUND OF THE INVENTION

The invention relates to modular structures forming office furniture to be used by personnel who work with blueprints or other documents that are kept in roll form which are adapted to be stored adjacent the working area on a table or desk.

In the prior art blueprints or other documents that are out of a central storage area, and in the area of the personnel working therewith, have been typically positioned loosely on a desk or working table in a manner so that they get in the way when not being used and/or roll off the desk. In general, when not in use and stored on a desk, such documents are difficult to position conveniently.

SUMMARY OF THE INVENTION

According to the invention, a convenient space saving storage grating has been provided for use in working tables or desks. The invention includes an opening formed in a desirable area of a work table to permit the neat storage of blueprints in a vertical arrangement.

A grating is formed in the opening by crossing rods which are secured in holes drilled into vertical surfaces of the opening.

Accordingly, it is an object of the invention to provide an improved storage arrangement for rolled documents in proximity to the area where they are to be used.

It is another object of the invention to provide a grating across an opening, as described in the preceding paragraphs, the grating forming a multiple number of separated spaces for groups of individual, rolled documents. The grating is formed by a plurality of parallel rods at one level and a plurality of parallel rods at a higher level, the latter rods crossing the former to provide the spacing arrangements.

It is a further object of the invention to provide a closure for the opening and adapted to sit on the rods, as described in the previous paragraphs, when the storage space is not in use.

It is a still further object of the invention to provide rods which are biased in place by a spring in one of two holes in which the rods are supported, and which are inserted or removed by moving one end of a rod against the spring in one of the holes and then either inserting it into an opposite hole or removing it from the opening.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes:

FIG. 1 is a perspective view of a grating in a working table in which rolled documents are stored according to the invention;

FIG. 2 is a fragmentary cross-sectional view, taken along the line 2—2 in FIG. 1;

FIG. 3 is an enlarged fragmentary view of the storage grating shown in FIG. 1;

FIG. 4 is a plan view of a grating arrangement illustrating another form of the grating, which provides additional storage spaces; and FIG. 5 is a cross-sectional view showing the storage area having a cover thereon, the cover forming a part of the working table surface when the storage area is not in use.

DESCRIPTION OF THE PREFERRED EMBODIMENT

Referring again to the drawings, there is shown in FIG. 1 a work area formed by partitions 10 and 12 to which are secured working tables or desks 16 and 18. As shown in FIGS. 1 and 2, a rectangular storage opening 20 for elongated material, such as rolled documents, is formed in the table 16. Under the opening 20, there is a container 17 to receive the lower portions of the documents.

The table has finishing laminations 22 on the top and 24 on the bottom, and in the opening, vertical edge surfaces are also formed by laminations 25, 26, 28 and an edge opposite 26, not shown. Inwardly of the laminations are blocks 30 and 32. There are two adjacent edges that have a block 30 and two adjacent edges that have a block 32.

As shown in FIGS. 2 and 3, extending through the laminations and into the blocks are spaced bored holes 34, 36 and 38. The holes 34 and 36 are about ½" in depth and the holes 38 opposite the holes 34, and the holes opposite the holes 36, not shown, are about 1" in depth. The holes 36 extend into the face 26 and are in alignment with opposite holes in the edge, not shown, the holes being perpendicular to the respective edges and at the same level. The holes 34 and 38 are also in alignment, perpendicular to the respective edges, and are at a higher level than the holes 36. The two levels of the holes provide for the crossing arrangements of rods 40 and 42 in the holes and forming the grating.

The holes 38, supporting rods 42, have a coil spring 44 therein and the holes opposite the holes 36 having rods 40 therein likewise have a coil spring 44. The rods are inserted into selected holes in accordance with the spacing arrangement desired in the grating formed. A rod, as 42, is inserted into a hole 38, the hole being somewhat larger in diameter than the rod so that the rod may be inserted before it is inserted in the opposite hole 34. Thus, when a rod 42 is moved into the opening 20, then into a hole 38, the spring 44 is compressed as the rod is moved down to a horizontal position opposite the hole 34. When it is in alignment with the hole 34 the rod is allowed to be moved into the hole 34, the spring being thereby expanded to the position shown and so as to maintain the rod within the two opposite holes. Springs may be inserted in the deeper holes, as 38, as needed.

In FIG. 4 another arrangement of rods 42 and 40 are shown. Here, there is only one rod 40 and there are three rods 42 forming a grating arrangement which provides eight spaces for rolled documents 44, 46 and 48.

In FIG. 5 the opening 20 is shown having the rods 42 and 40 therein, but is not being used for storage. For situations where storage is not required, a rectangular cover 50 is made to be fitted into the opening 20 on top of the rods 42 to form a continuation of the table surface 16. The cover 50 has a finished laminated top which matches the surface 16.

The invention and its attendant advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims, wherein various portions have been separated for clarity of reading and not for emphasis.

I claim:

1. A working table having a grating for vertical storage of material in elongated form, comprising:

a working table having a vertically directed opening therethrough, at least one vertical edge portion forming the surface of said opening, a plurality of first opposite aligned pairs of horizontal holes in said vertical edge, and at least one rod extending across said opening and having one end in one of a pair of selected aligned holes and having its other end in the other of said pair of holes.

2. The invention according to claim 1 including:

a plurality of second opposite aligned pairs of horizontal holes in said vertical edges, said second pairs of holes being at a level just above said first pairs and the alignment directions of said first and second pairs being in a crossing relationship, at least one rod extending across said opening and having one end in one of a second pair of selected aligned holes and having its other end in the other of said second pair of holes, said rods being in a crossing relationship.

3. The invention according to claim 2 in which:

said holes terminate in inner ends inwardly of said surface, one hole of each pair of aligned holes being deeper than the other, said rods being longer than said opening, said deeper one hole having a coil spring therein in abutment with its inner end and being deep enough to receive one end of a rod in abutment with said spring with the other end of the rod being in said opening outwardly of said opposite hole, said spring being adapted to force said other end of the rod into said opposite hole and in abutment with its inner end, said one end of the rod remaining in said deeper one hole in abutment with said spring.

4. The invention according to claim 3 in which:

a container is positioned below said opening to receive the lower ends of said material extending through said opening.

5. The invention according to claim 3 in which:

said opening is rectangular and said opposite holes are aligned in directions perpendicular to edge portions forming the surface of said opening, said rods crossing at right angles.

6. The invention according to claim 5 in which:

said plurality of first pairs of opposite aligned holes are spaced along the surface of said edge portions forming two first opposite sides of said rectangle, said plurality of second pairs of opposite aligned holes are spaced along the surface of said edge portions forming two second opposite sides of said rectangle, at least two of said rods extending across said opening and having their ends in respective first pairs of spaced holes, at least two of said rods extending across said opening and having their ends in respective second pairs of spaced holes, said rods forming nine separate storage spaces in said opening.

7. The invention according to claim 6 including:

a cover fitting into and closing said opening when no material is stored therein, said cover being supported on said rods in said second pairs of spaced holes.

* * * * *